US005645043A

United States Patent [19]

Long et al.

[11] Patent Number: 5,645,043

[45] Date of Patent: Jul. 8, 1997

[54] RADIANT HEATER

[75] Inventors: Norris R. Long; Clyde R. Schulte; Rick L. Looslie, all of Wichita; Franklin T. Schmidt, Mulvahe, all of Kans.

[73] Assignee: The Coleman Company, Inc., Wichita, Kans.

[21] Appl. No.: 589,642

[22] Filed: Jan. 22, 1996

Related U.S. Application Data

[63] Continuation of Ser. No. 374,423, Jan. 25, 1995, abandoned.

[51] Int. Cl.[6] ..... F24C 3/04

[52] U.S. Cl. ..... 126/92 AC; 126/92 B; 126/91 R; 431/328

[58] Field of Search ..... 126/92 AC, 92 B, 126/91 R; 431/268, 329, 328

[56] References Cited

U.S. PATENT DOCUMENTS

| | | |
|---|---|---|
| D. 288,473 | 2/1987 | Schmidt . |
| 1,822,356 | 6/1931 | McCartney . |
| 2,825,325 | 3/1958 | Ross . |
| 3,229,680 | 1/1966 | Herbert . |
| 3,852,025 | 12/1974 | Placek . |
| 3,941,116 | 3/1976 | Placek . |
| 3,975,140 | 8/1976 | Placek . |
| 4,063,876 | 12/1977 | Schweiss . |
| 4,378,783 | 4/1983 | Hunter . |
| 4,569,329 | 2/1986 | Cherryholmes . |
| 4,624,241 | 11/1986 | Cherryholmes . |
| 4,782,814 | 11/1988 | Cherryholmes . |
| 5,336,084 | 8/1994 | Long . |
| 5,353,694 | 10/1994 | Fins . |
| 5,368,475 | 11/1994 | Suppiah . |

OTHER PUBLICATIONS

Advertising Material for Reddy Heater Model HD12B (no date).

Owner's Manual and Operating Instructions for Paulin Heater (no date).

Advertising Material for Paulin Heater (no date).

Advertising Material for Mr. Heater Heater (no date).

Installation and Operating Instructions for Mr. Heater heater (no date).

Coleman catalog page for Focus Propane Heaters.

Owner'Manual for Infra–Red Tank Top Heater Model HD12B.

Advertising Material for Reddy Heater Model HD12.

*Primary Examiner*—Larry Jones

[57] ABSTRACT

A radiant heater which burns LPG fuel is provided with an improved burner assembly and an improved support assembly for mounting the heater on a propane tank. The heater includes a frame, a reflector mounted on the frame, and a burner assembly which is removably mounted within the reflector and the frame. The burner assembly includes a burner tube having an inlet end mounted within the frame and an outlet end positioned within the reflector. A generally dome-shaped screen is mounted on the outlet end of the burner tube, and a generally circular screen is attached to the dome-shaped screen substantially in alignment with the burner tube. A burner pan is mounted on the burner tube and surrounds the dome-shaped screen, and an outer screen extends across the burner pan. A thermocouple sensor and/or an igniter electrode on the frame extends through one or more openings in the burner pan. A single fastener prevents removal of the burner assembly from the frame, and when the fastener is disengaged from the burner assembly, the burner assembly can be removed and replaced. The support assembly includes a rigid support member which extends downwardly from the frame and is releasably engageable with an LPG tank. In one embodiment the support member is a fuel conduit which is connectable to a fuel valve on the LPG tank. A support bracket is adjustably mounted on the fuel conduit and is engageable with the top of the LPG tank.

31 Claims, 11 Drawing Sheets

FIG. 19
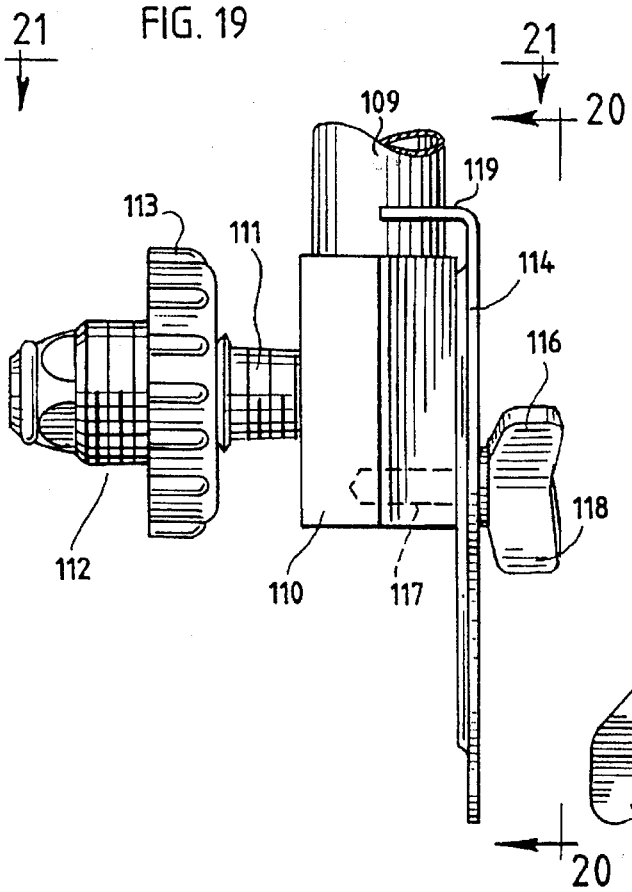
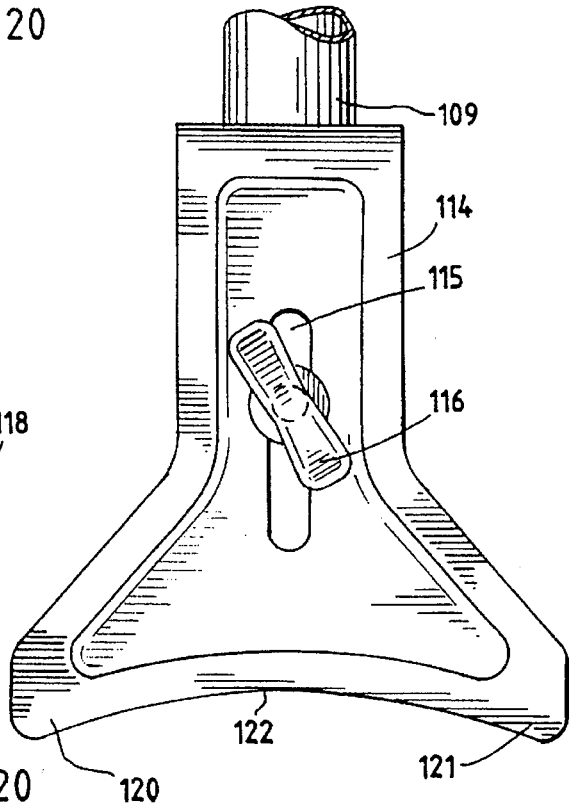
FIG. 20
FIG. 21
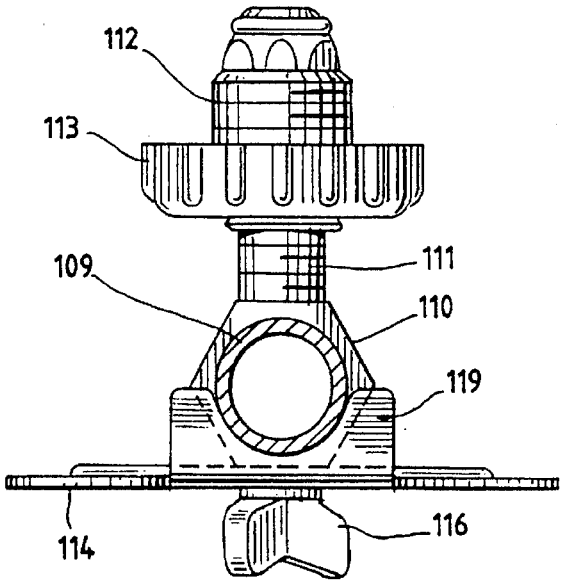

RADIANT HEATER

RELATED APPLICATION

This application is a continuation of the application entitled RADIANT HEATER, Ser. No. 08/374,423, filed Jan. 25, 1995, now abandoned.

BACKGROUND

This invention relates to radiant heaters which are fueled by liquefied petroleum gas (LPG). More particularly, the invention relates to a radiant heater which is equipped with an improved burner assembly and an improved support assembly for mounting the heater on a propane tank.

Radiant heaters, sometimes called infrared heaters, which are powered by LPG such as propane, butane, isobutane and mixtures thereof are well known. For example, U.S. Pat. Nos. 4,782,814, 4,624,241, and 4,569,329 describe such radiant heaters. The heaters described in those patents are specifically designed for use with relatively small disposable LPG fuel tanks, which contains, for example, about 12 ounces of fuel.

Other radiant heaters are designed for use with larger refillable LPG tanks which can hold 20 pounds or more of fuel. Radiant heaters which are designed for use with refillable LPG tanks are generally mounted directly on the tank, for example, by connecting the fuel tube of the heater to the standard POL outlet valve of the tank.

Radiant heaters used with large, refillable LPG tanks generally provide more heat output than heaters which are used with smaller, disposable LPG tanks. However, even though the larger tanks have a substantial fuel capacity, the heat output of radiant burners has heretofore been limited. Heat output of radiant heaters is conventionally measured by the amount of fuel which is consumed by the heater in terms of Btu's per hour. The rating of prior heaters is generally limited to about 12,000 to 15,000 Btu's per hour.

The burner assembly of a radiant heater conventionally includes a burner tube for conveying a mixture of fuel and air, a porous burner head on the outlet end of the burner tube, a burner pan which surrounds the burner head, and an outer screen which extends across the burner pan. The burning fuel/air mixture heats the screen on the burner pan, and heat radiating from the burner head heats the adjacent environment.

It is desirable to confine the flame of the fuel/air mixture in the space between the porous burner head and the outer screen. It is also desirable to avoid excessively heating the outer screen which might cause the screen to deteriorate or burn away, thereby requiring replacement. However, the flame should be hot enough to provide the desired radiant heat and to provide substantially complete combustion in order to reduce the amount of unburned and partially burned hydrocarbons which are emitted from the heater.

The flow of the fuel/air mixture into the burner assembly creates noise which is clearly audible, particularly when the heater is being operated at maximum output. It is also desirable to maintain the noise at an acceptable level.

The foregoing design requirements have heretofore limited the heat output of LPG radiant heaters to about 12,000 to 15,000 Btu's per hour per burner assembly. Higher heat output was available only by using multiple burner assemblies.

The dimensions of the outer screen are generally maintained relatively small so that the screen can be heated substantially uniformly without excessive hot spots and to reduce emissions of partially burned hydracarbons. However, limiting the size of the screen also limits the heat output.

The screens on the burner pan and the burner head are subject to deterioration over time and require replacement. Generally, the higher the heat output, the more frequently the screens need to be replaced. In many heaters replacement of the burner pan screen or burner head screen is a time-consuming and laborious task.

Replacement of the screens is further complicated if the heater is equipped with a thermocouple sensor or an electronic ignition system. Many heaters have a thermocouple sensor mounted near the burner head in order to shut off the flow of fuel if the flame goes out. An electronic ignition system facilitates lighting the heater and includes a piezoelectric electrode adjacent the burner head. Replacement of the burner head often requires disassembly of the thermocouple sensor and the electrode.

A radiant heater which is designed for use with refillable LPG tanks is generally mounted on and supported by the tank. Many heaters are supported solely by a rigid fuel tube which is part of the heater and which is connected to the fuel outlet valve of the tank. However, such a connection imposes stress on the valve connection at the tank.

SUMMARY OF THE INVENTION

One aspect of the invention is a radiant heater with an improved burner assembly which is easily replaceable and which provides high heat output over a prolonged useful life, uniform heating, low noise, and relatively low emissions of unburned and partially burned hydrocarbons. Another aspect of the invention provides an improved, stable mounting assembly for connecting and mounting the heater on an LPG tank.

The burner assembly is mounted within a reflector and includes a burner tube which is slidably mounted in the reflector and the heater and which is releasably retained by a single fastener. A burner head mounted on the outer end of the burner tube includes a generally dome-shaped outer screen and a generally circular inner screen which is attached to the outer screen in alignment with the burner tube. A burner pan extends outwardly from the burner tube behind the burner head, and a third screen extends across the top of the burner pan to provide a burner enclosure within the pan. The circular inner screen makes the central portion of the dome-shaped screen more dense and forces some of the fuel/air mixture to flow through the outer portions of the dome-shaped screen. The flame within the burner enclosure is therefore spread substantially uniformly throughout the burner enclosure, and the outer screen is substantially uniformly heated. The diameter of the burner tube and the dimensions of the burner pan are relatively large to provide a high heat output, but the circular screen maintains the noise at an acceptable level. The flame within the burner enclosure burns at a high temperature so that emissions of unburned and partially burned hydrocarbons are low, but the uniform spreading of the flame reduces deterioration of the screens and prolongs the useful life of the burner assembly. Even though the dimensions of the burner pan are relatively large, the circular screen and the resultant uniform spreading of the flame enables the depth of the burner enclosure to be maintained relatively small, thereby reducing the bulk of the burner assembly. A thermocouple sensor and an igniter electrode and mounted in the reflector and extend through openings in the burner pan, and the burner assembly can be removed and replaced simply by removing the fastener and sliding the burner assembly out of the heater.

One embodiment of the mounting assembly for the heater includes a rigid fuel tube which is connected to the outlet valve of the LPG tank and a support bracket which is adjustably and clampingly mounted on the fuel tube for engaging the top of the tank.

A second embodiment of the mounting assembly includes a rigid support member which extends downwardly from the heater, a support bracket on the lower end of the support member which is engageable with the collar of an LPG tank, and a generally L-shaped fastener on the lower end of the rigid support member which can clamp the collar between the fastener and the rigid support member.

DESCRIPTION OF THE DRAWING

The invention will be explained in conjunction with illustrative embodiments shown in the accompanying drawing, in which

FIG. 19 is a fragmentary side view of another embodiment of a mounting assembly for the radiant heater;

FIG. 20 is a view of the mounting assembly taken along the line 20—20 of FIG. 19;

FIG. 21 is a view of the mounting assembly taken along the line 21—21 of FIG. 20;

DESCRIPTION OF SPECIFIC EMBODIMENT

Figure 1:
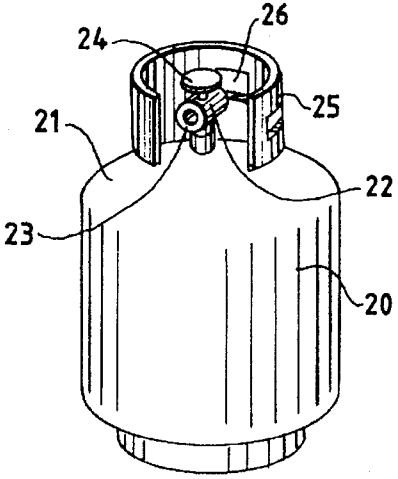
FIG. 1 is a perspective view of a conventional refillable LPG tank.

FIG. 1 illustrates a conventional refillable LPG tank 20 which is well known in the art. Such an LPG tank commonly holds up to about 30 pounds of fuel, although the invention can be used with smaller and larger tanks. The conventional LPG tank includes a generally dome-shaped top 21 and a POL outlet valve 22 which is screwed into the top of the tank. The POL valve includes an internally threaded connector 23 and a knob 24 for opening and closing the valve. The valve is protected by a generally cylindrical collar 25 which extends partway around the valve and which is provided with one or more openings 26 to facilitate carrying the tank.

Heater

Figure 2:
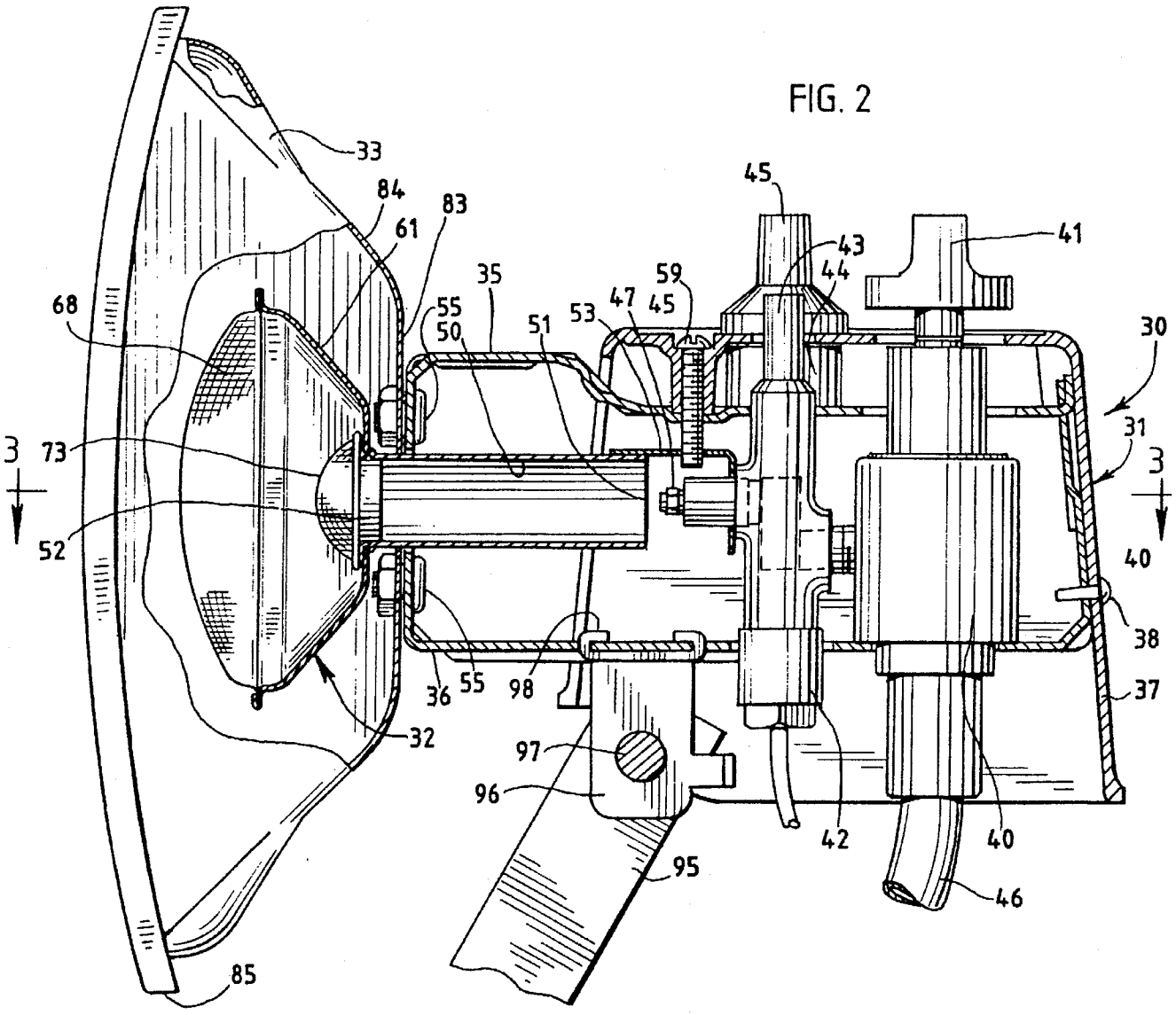
FIG. 2 is a fragmentary sectional view of a radiant heater formed in accordance with the invention.
Figure 12:
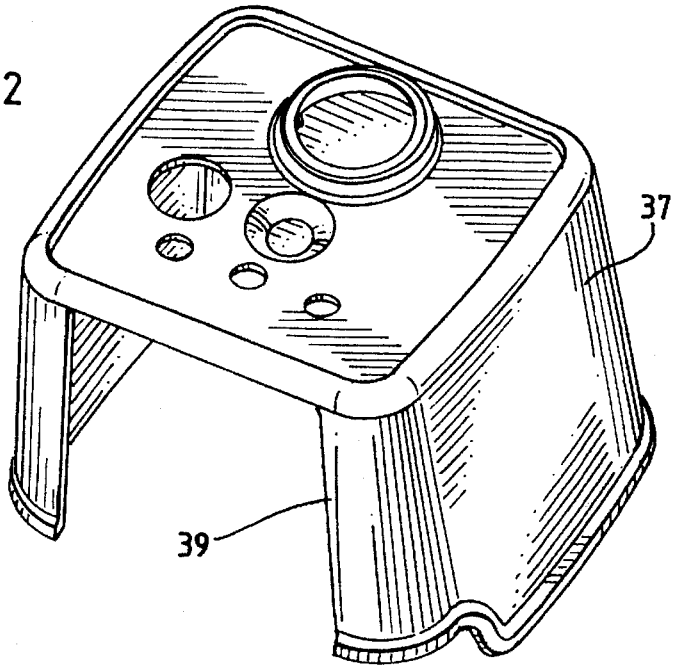
FIG. 12 is a perspective view of the plastic housing.

Referring to FIG. 2, a radiant heater which is designated generally by the reference numeral 30 includes a frame assembly 31, a burner assembly 32, and a reflector 33. The frame assembly 31 includes upper and lower metal standoff brackets 35 and 36 and a plastic housing 37 (see also FIG. 12) which is secured to the brackets by rivets 38. The brackets extend forwardly through a rectangular opening 39 in the front wall of the plastic housing.

The frame assembly encloses a conventional fuel regulating valve 40 which is operated by a control knob 41 above the housing, a conventional thermocouple safety shut-off assembly 42 which includes a pushbutton 43, and a conventional piezoelectric spark generator 44 which is operated by a pushbutton 45.

The regulating valve 40 is connected to an LPG fuel tank by a flexible fuel hose 46 which terminates in a conventional externally threaded male coupler (not shown) which screws into the POL valve on the tank. The operating knob 41 of the regulating valve opens and closes the valve and regulates the amount of fuel which flows through the valve. The regulator maintains the fuel flow substantially constant regardless of the ambient temperature or the amount of fuel in the tank. The regulating valve assembly includes a circular fuel outlet conduit 47 which terminates an end fitting 48 which is provided with a fuel outlet orifice.

The burner assembly includes an elongated cylindrical burner tube 50 which has a rear inlet end 51 which is positioned adjacent the fuel outlet orifice and a forward outlet end 52 which extends beyond the front ends of the brackets 35 and 36. The inlet end of the burner tube is supported by a L-shaped bracket 53, and the outlet end of the burner tube is supported in an opening in the reflector 33. The reflector is bolted to the top and bottom brackets 35 and 36 by four bolts 55. The burner tube extends through the opening 39 in the plastic housing 38 between the top and bottom brackets and is substantially completely exposed to the ambient air between the top and bottom brackets.

Figure 6:
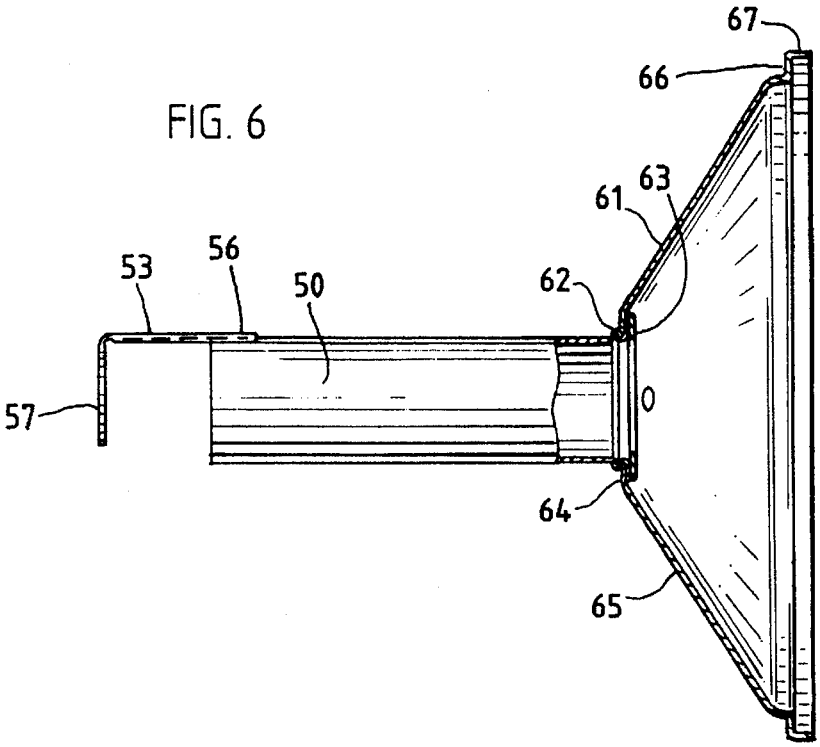
FIG. 6 is a side elevational view of the burner tube and burner pan.
Figure 7:
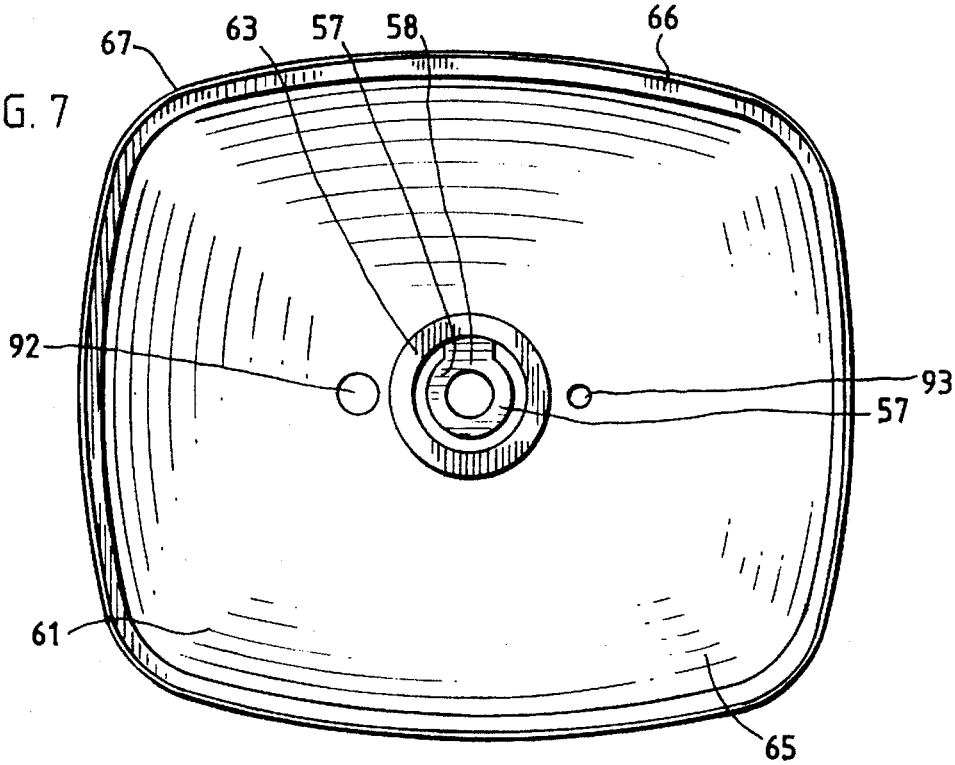
FIG. 7 is a front elevational view of the burner tube and burner pan taken along the line 7—7 of FIG. 6.

Referring to FIGS. 6 and 7, the L-shaped bracket 53 includes an attaching portion 56 which is welded to the burner tube and extends longitudinally rearwardly and a downwardly extending portion 57. The downwardly extending portion is provided with a circular opening 58 so that the bracket can slide over, and be supported by, the cylindrical fuel conduit 45.

The outlet end of the burner tube is slidably supported by the reflector 33, and the burner tube is retained in position within the heater by a single fastener 59. The fastener is threadedly engaged with an opening 60 (FIGS. 3 and 4) in the plastic housing and extends through an opening in the attaching portion 56 of the bracket 53.

Referring again to FIGS. 6 and 7, a burner pan 61 is mounted on the outlet end of the burner tube by means of a crimp 62 and an outwardly extending flange 63 on the burner tube. The burner pan includes a flat rear wall 64, an outwardly diverging side wall 65, an outwardly extending shoulder 66, and a forwardly extending flange 67.

Figure 8:
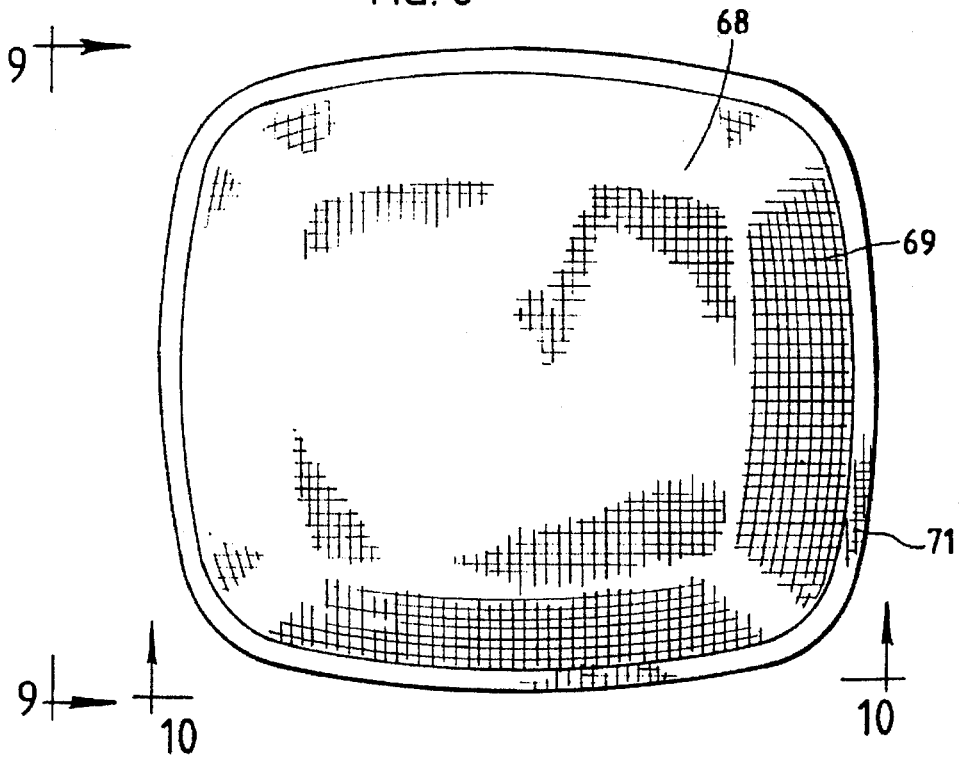
FIG. 8 is a front view of the screen for the burner pan.
Figure 9:
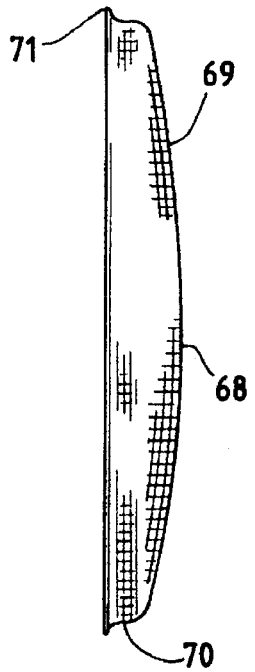
FIG. 9 is a side view of the screen of the burner pan taken along the line 9—9 of FIG. 8.
Figure 10:
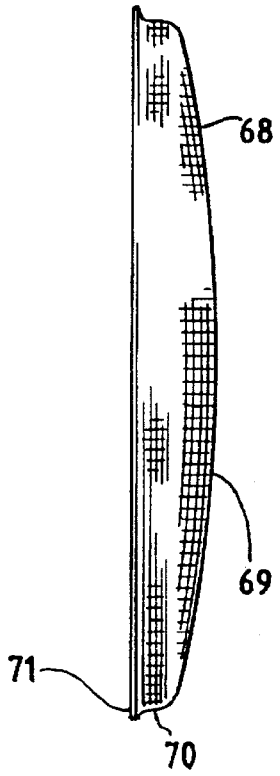
FIG. 10 is a bottom view of the screen for the burner pan taken along the line 10—10 of FIG. 8.

A generally convex burner pan screen 68 (FIGS. 8–10) is attached to the rim of the burner pan. The burner pan screen includes a convex outer or forward portion 69, a rearwardly extending side wall 70, and a laterally outwardly extending flange portion 71. The flange portion 71 is mounted on the shoulder 65 of the burner pan, and the flange 66 of the burner pan is crimped over the flange 71 of the screen to secure the screen (FIG. 2).

In one specific embodiment the burner pan screen was a 40×40 mesh made from Inconel 600 wire having a diameter of about 0.0085 to 0.010 inch. The screen had about 43 to 36% open area. The outer peripheries of the burner pan and the burner pan screen were generally rectangular. The convex front portion of the screen bounded by the side wall 70 had dimensions of about 6.20 inches by about 5.40 inches. The distance between the center of the convex front portion of the screen and the outlet end of the burner tube was about 2.0 inches, and the distance between the center of the convex front portion of the screen and the back of the burner pan was about 2.15 inches.

Figure 5:
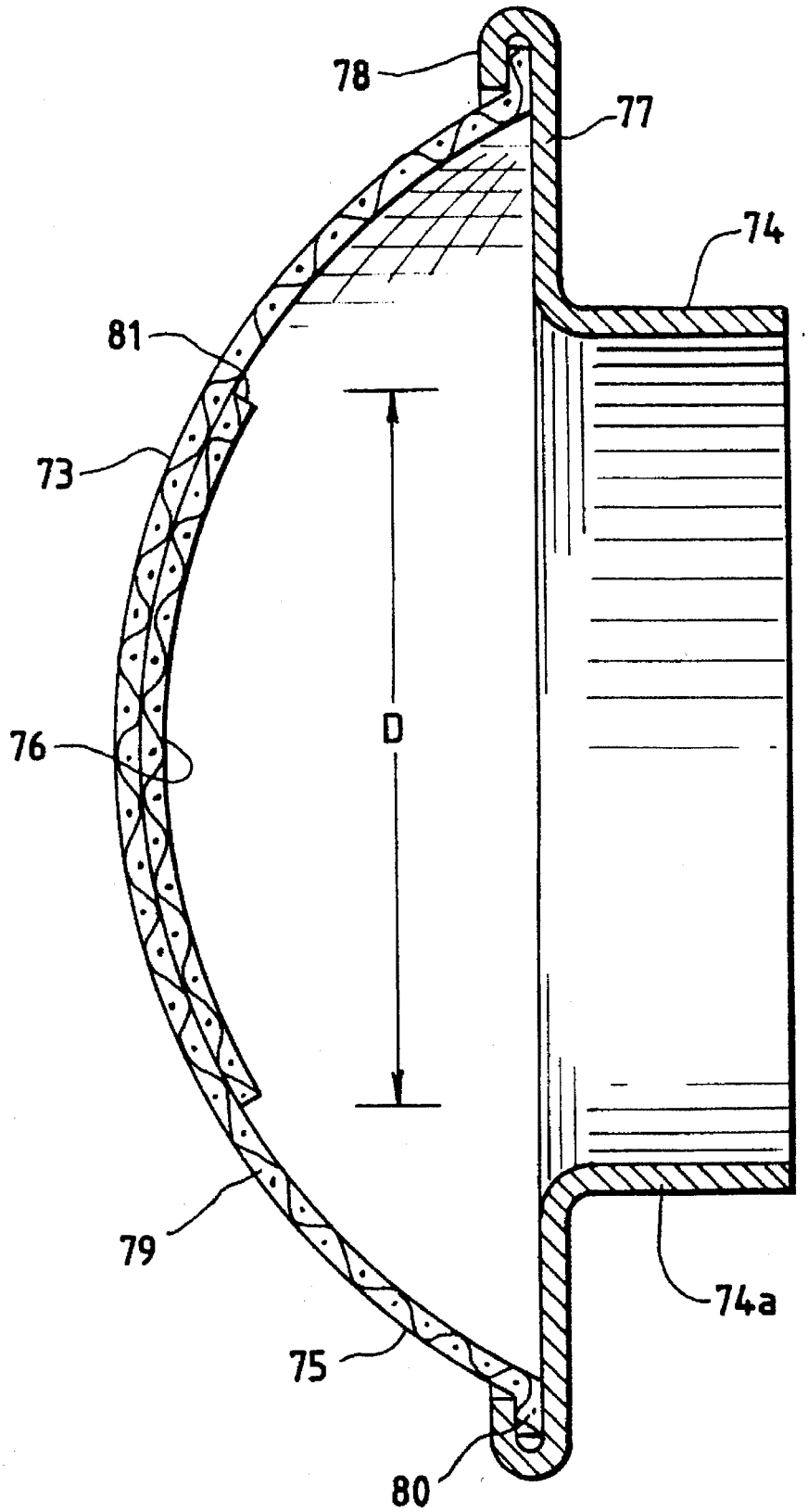
FIG. 5 is an enlarged sectional view of the burner head.

Before the burner pan screen 68 is secured to the burner pan, a burner head 73 is mounted in the outlet end of the burner tube 50. Referring to FIG. 5, the burner head includes a base 74, a dome-shaped or convex screen 75, and a generally circular screen 76 which is secured to the screen 75 by spotwelding or the like.

The base 74 is formed from metal and includes a cylindrical portion **74*a* which is inserted snugly into the burner tube, an annular portion 77, and a flange 78 which clamps the screen 75 against the annular portion 77**.

The dome-shaped screen 75 includes a dome portion 79 and an annular flange portion 80. The screen 76 is originally in the form of a flat circle but assumes substantially the shape of the domed screen 75 when it is secured to the screen 75. The periphery 81 of the screen 76 is substantially circular, and the diameter or chord D of the periphery is preferably substantially the same as the inside diameter of the burner tube 50. The generally circular screen 76 is attached to the screen 76 so that it is generally aligned with the burner tube.

In one specific embodiment of the burner head, the screens 75 and 76 were made from the same material as the burner pan screen 68. The radius of the dome-shaped screen 75 was about 0.58 inch, and the diameter D of the circular periphery of the screen 76 was about 1 inch. The inside diameter of the burner tube was also about 1 inch. The dimension between the center of the dome-shaped screen 75 and the annular portion 77 of the base was about 0.62 inch.

Figure 11:
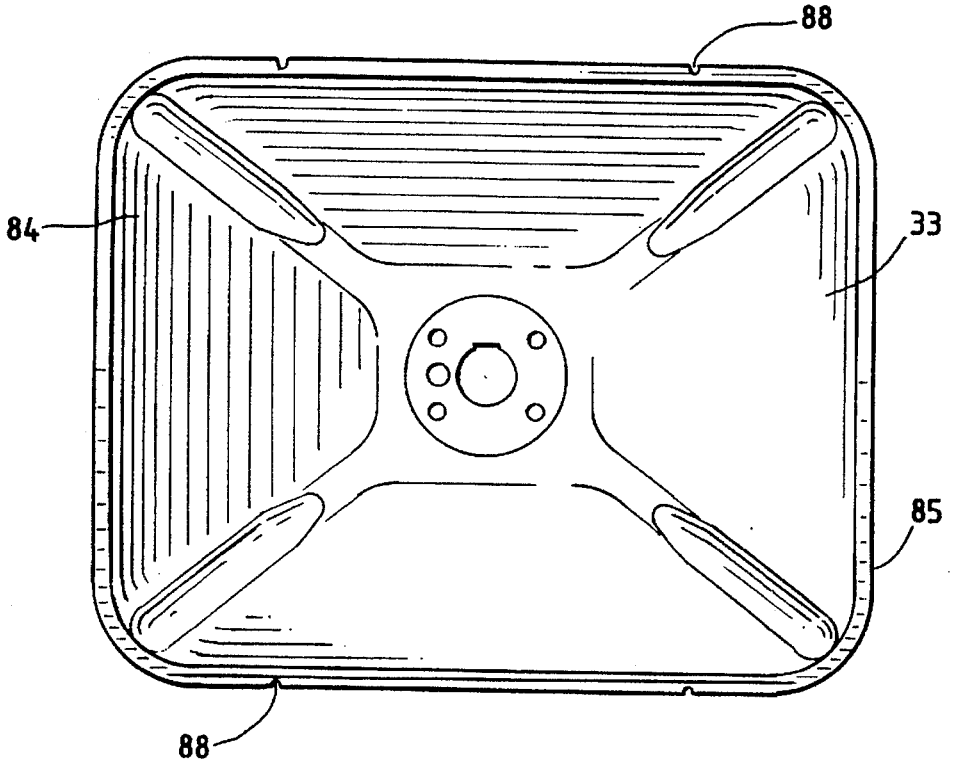
FIG. 11 is a front elevational view of the reflector.

The reflector 33 substantially surrounds the burner pan 61 and the burner pan screen 68 and extends forwardly beyond the burner pan screen. The reflector includes a flat rear wall 83, a forwardly diverging wall 84, and a generally rectangular outer rim 85 (see also FIG. 11). A central opening 86 (FIG. 11) is sized to slidably receive and support the burner tube 50, and the opening is provided with a rectangular notch 87 to permit the L-shaped bracket 53 to pass through the opening.

The outer rim 85 of the reflector is provided with notches 88 for mounting a conventional wire guard on the front of the reflector. The wire guard is easily removable from the reflector when the burner assembly needs to be replaced.

Figure 22:
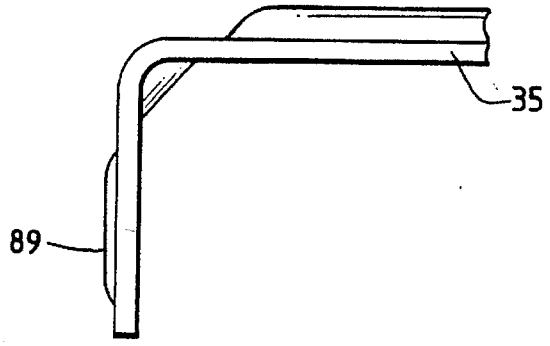
FIG. 22 is a fragmentary side view of the top standoff bracket.
Figure 23:
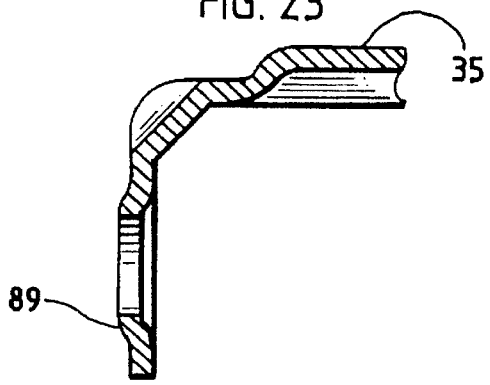
FIG. 23 is a fragmentary sectional view of the top standoff bracket.
Figure 24:
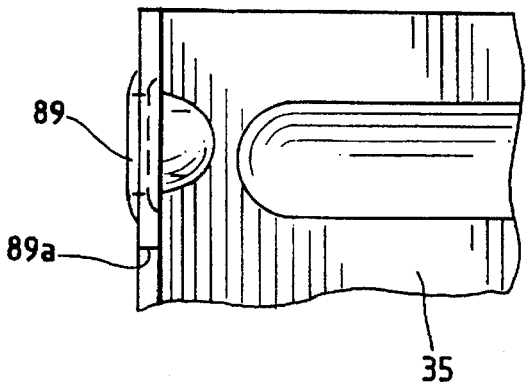
FIG. 24 is a fragmentary bottom view of the top standoff bracket taken along the line 24—24 of FIG. 22.

The reflector is mounted on the standoff brackets 35 and 36 in a way which minimizes heat transfer from the reflector to the brackets. It is desirable to minimize the heat which reaches the regulating valve assembly 40, the spark generator 44, the plastic housing 37, and the other components which are covered by the housing. Referring to FIGS. 22–24, the front surface of each bracket includes an outwardly extending embossment 89 which surrounds each of the bolt holes for the bolts 55. The embossments space the back of the reflector slightly forwardly from the front surfaces of the brackets and minimize the direct contact between the reflector and the brackets.

Each bracket is provided with a semicircular notch **89*a* which surrounds the burner tube 50 so that the brackets do not contact the burner tube. The burner assembly is therefore supported only by the edge contact between the support bracket 53 and the fuel outlet conduit 45** and by the edge contact between the burner tube and the opening in the reflector.

Figure 3:
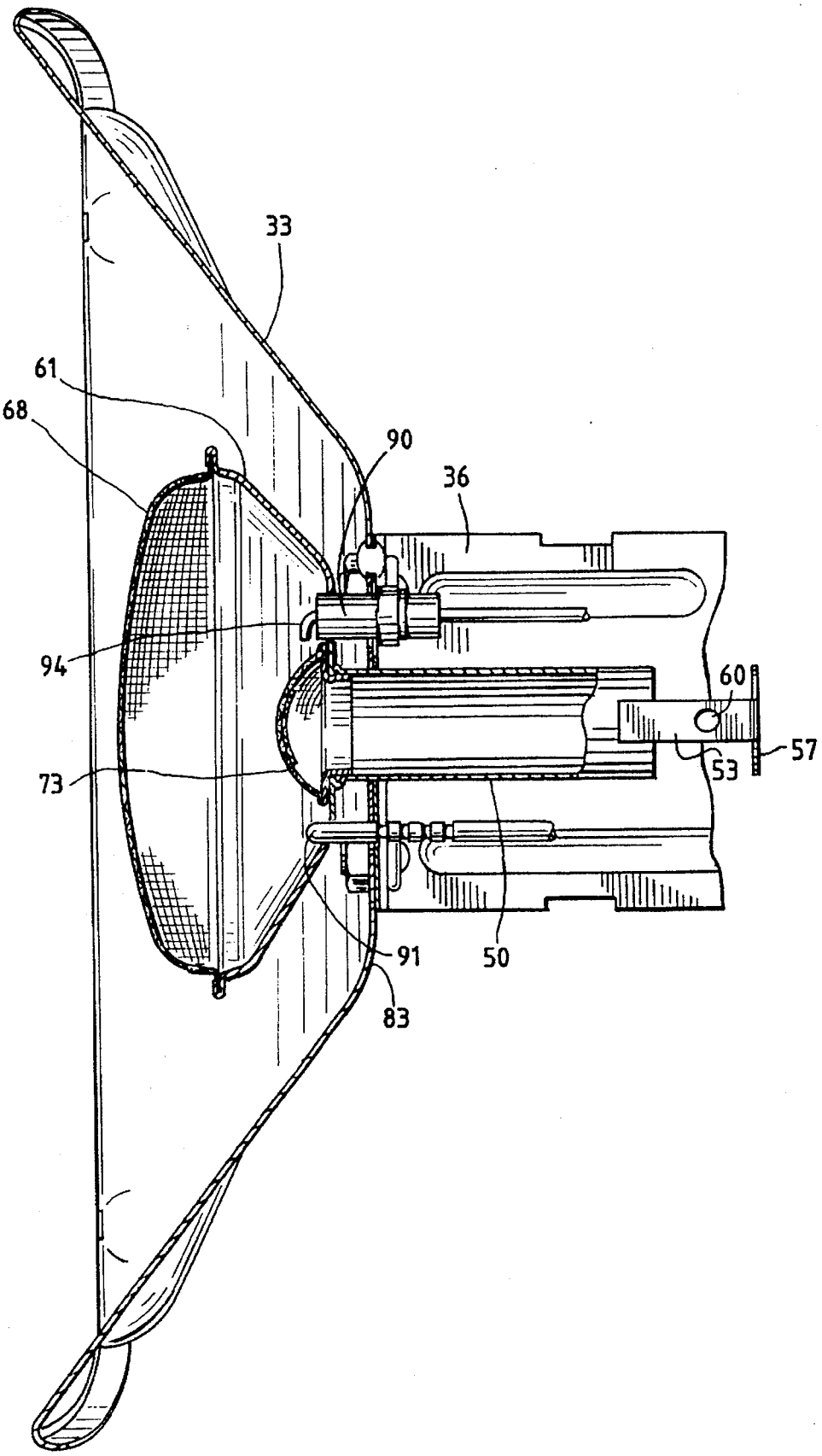
FIG. 3 is a fragmentary sectional view taken along the line 3—3 of FIG. 2.
Figure 4:
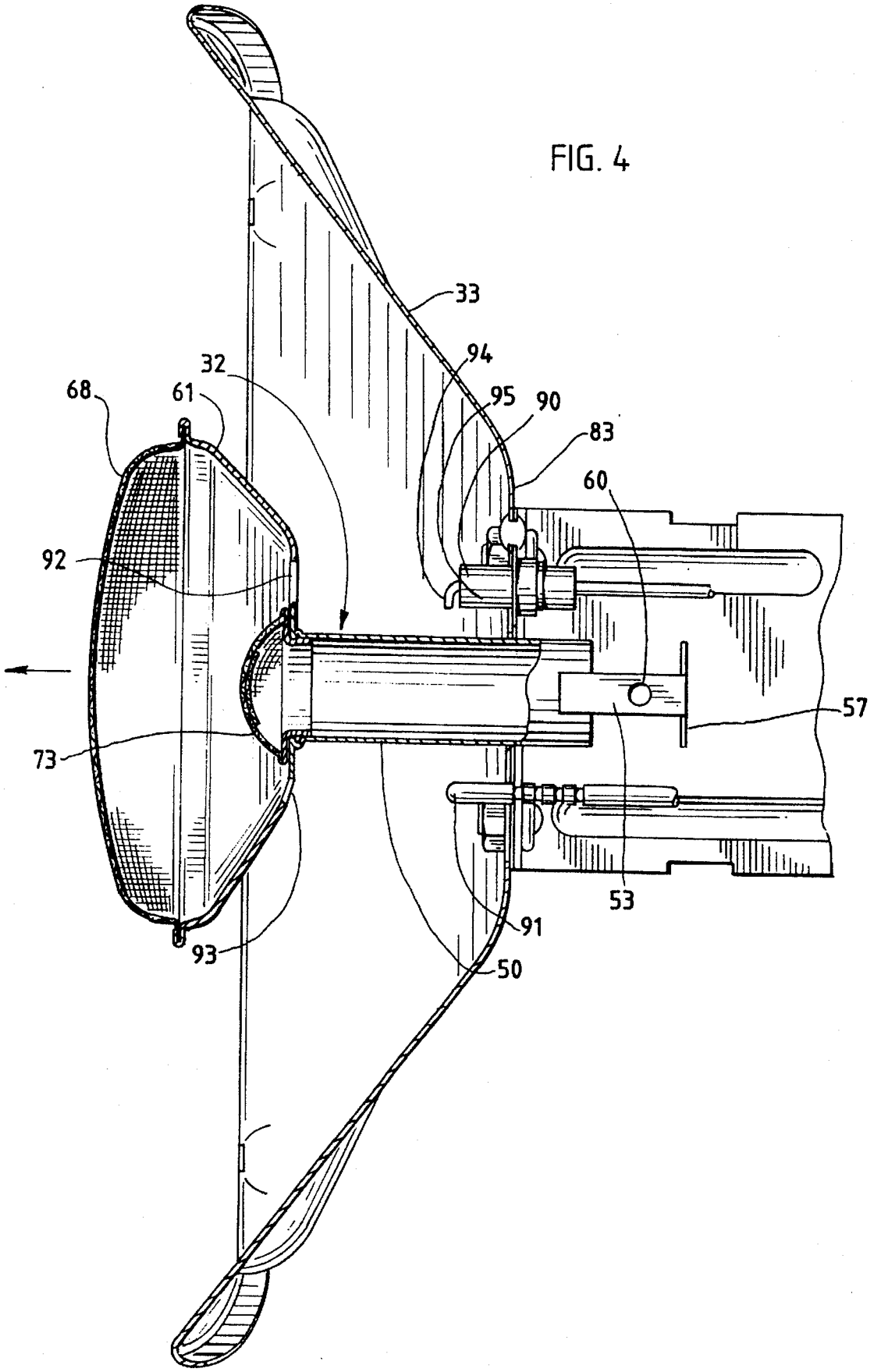
FIG. 4 is a view similar to FIG. 3 showing the burner assembly in the process of being removed from the heater.

Referring to FIGS. 3 and 4, an igniter electrode 90 and a thermocouple sensor 91 are mounted in openings in the reflector 54. The electrode and thermocouple sensor extend through openings 92 and 93 (FIGS. 4 and 7) in the burner pan 61 and terminate adjacent the burner pan screen 68.

The electrode 90 is a conventional piezoelectric electrode and includes a wire 94 and a generally cylindrical insulator 95. The wire is electrically connected to the piezoelectric spark generator 44. The outer end of the wire 94 curves toward the burner pan screen 68 so that a spark jumps to the screen when the pushbutton 45 is pushed. However, the end of the wire is maintained within the periphery of the insulator 95 so that the burner pan can be withdrawn from the electrode and the reflector as illustrated in FIG. 4.

The thermocouple sensor 91 is connected to the thermocouple shut-off assembly 42. The end portion of the thermocouple sensor which extends into the burner pan is straight so that the burner pan can be withdrawn from the sensor as shown in FIG. 4.

Mounting Assembly

Referring to FIGS. 1 and 13–18, the radiant heater is mounted on an LPG tank by a rigid metal tube 95 which is pivotally connected to a stud 96 on the heater by a bolt 97. A wing nut or other clamping device is mounted on the bolt so that the heater can be retained in a desired orientation. The stud 96 is secured to the lower bracket 36 of the heater by crimps 98.

The tube 95 has a rectangular cross section and is slightly angled so that the heater is centered over the tank when the tube is clamped to the collar of the tank. A support bracket 99 is welded to the lower end of the tube, and the bracket includes a pair of U-shaped hooks 100 and 101.

An L-shaped bolt 102 extends through a hole 103 in the bottom of the tube. The bolt includes a threaded shank 104 and an end portion 105 which extends perpendicularly to the shank. A knob 106 is threadedly engaged with the shank. A recess 107 is provided in the bottom of the tube so that the end portion 105 of the fastener can be pulled into the recess as illustrated in FIG. 13.

Figure 13:
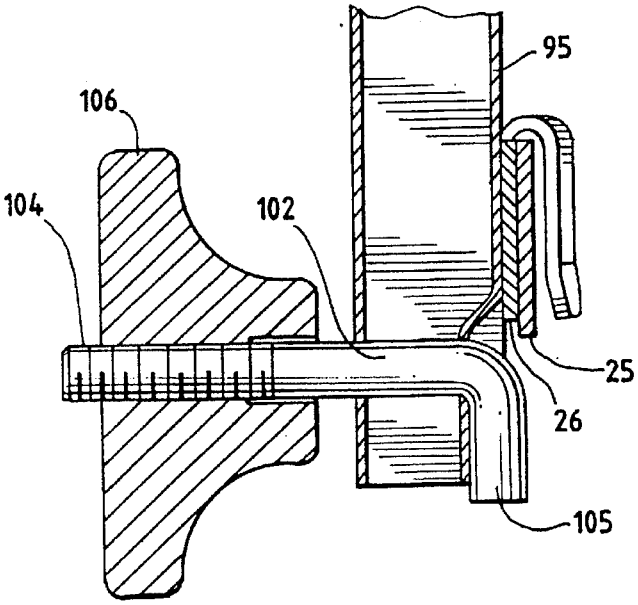
FIG. 13 is a fragmentary sectional view of one embodiment of the mounting assembly for the radiant heater illustrating the mounting assembly in the process of being connected to a collar of an LPG tank.

The mounting assembly is clamped onto a collar 25 (FIG. 1) of an LPG tank 20 by pushing the tube 95 downwardly along the outside of the collar until the hooks 100 and 101 engage the upper edge of the collar as illustrated in FIG. 13. The U-shaped bight portions of the hooks provide support shoulders which engage the collar. Positioning the end portion 105 of the fastener in the recess 107 permits the fastener to pass downwardly along the outside of the collar.

Figure 14:
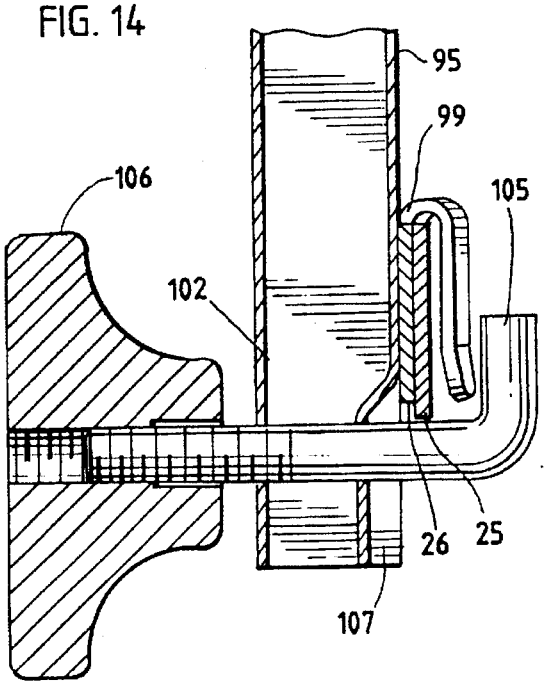
FIG. 14 is a fragmentary sectional view illustrating a later step of attaching the mounting assembly to the collar of an LPG tank.
Figure 15:
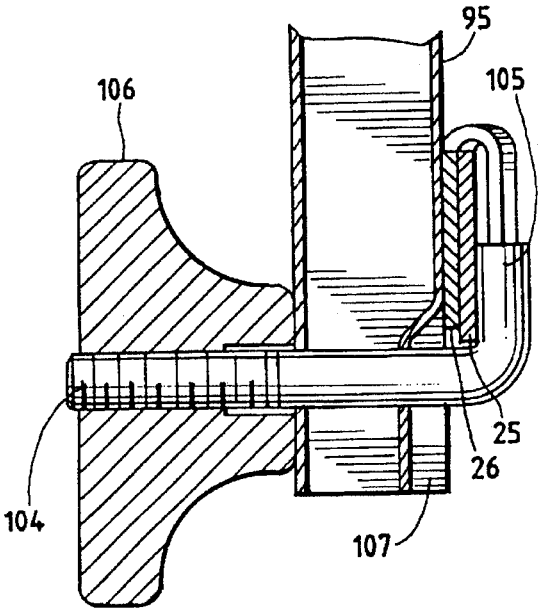
FIG. 15 is a fragmentary sectional view illustrating the mounting assembly mounted on the collar of an LPG tank.
Figure 16:
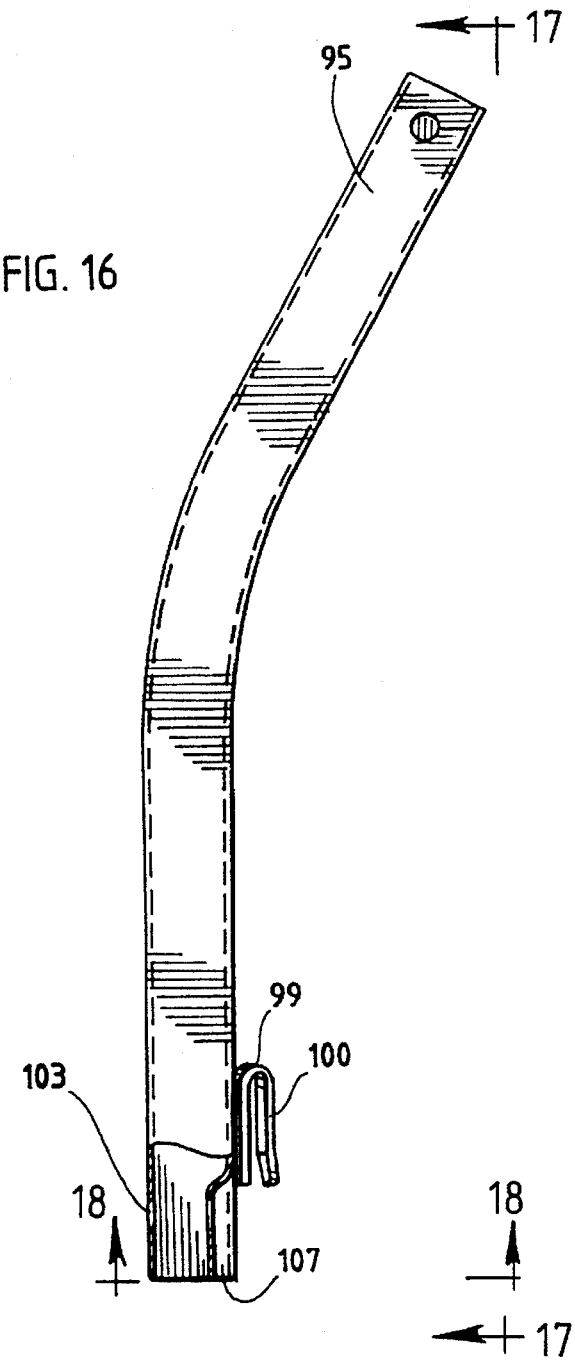
FIG. 16 is a side elevational view, partially broken away, of the support member of FIGS. 13–15.
Figure 17:
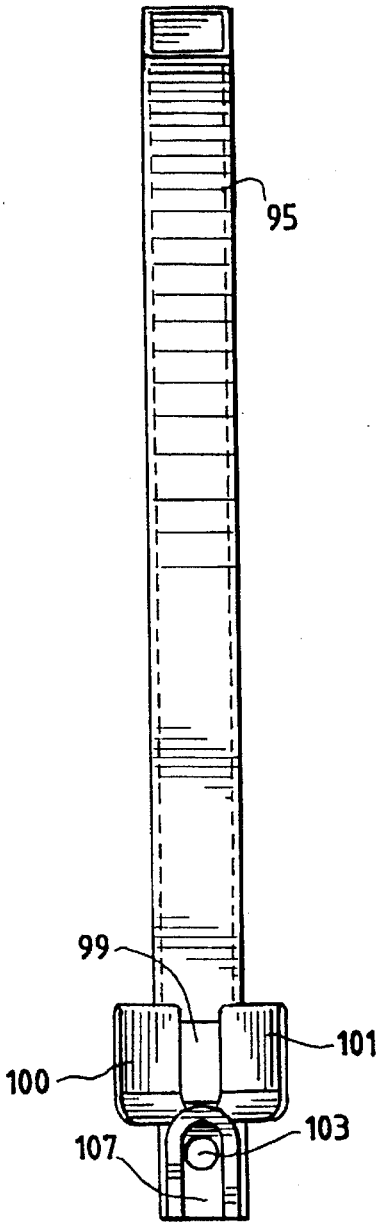
FIG. 17 is a view of the support member taken along the line 17—17 of FIG. 16.
Figure 18:
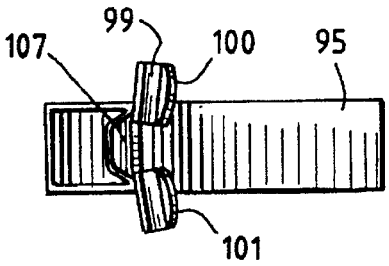
FIG. 18 is a bottom view of the support member taken along the line 18—18 of FIG. 16.

The fastener is then pushed through one of the openings 26 in the collar as illustrated in FIG. 14, and the end portion 105 is turned upwardly. The knob 106 is then rotated to clamp the collar between the end portion 105 and the bracket 99 which is secured to the tube 95.

Another embodiment of a mounting assembly is illustrated in FIGS. 19–21. Referring to FIG. 2, the flexible fuel hose 36 is eliminated, and a rigid metal tube 109 (FIG. 19) is connected to the fuel regulating valve 40. A metal hexagonal bushing 110 is connected to the bottom of the tube 109, and a conventional LPG male connector stem 111 is connected to the bushing at a right angle to the tube 109. A conventional externally threaded POL connector 112 is rotatably mounted on the stem 111 and includes a knob 113. A metal support bracket 114 is slidably connected to the bushing 110 by a slot 115 and a fastener 116. The fastener includes a threaded shank 117 which is screwed into a threaded opening in the bushing and a head 118 having the shape of a wing nut. Alternatively, the fastener can include a stud which is fixed to the bushing and a wing nut which is screwed onto the stud.

The upper end of the bracket includes an inwardly extending forked portion 119 (FIG. 21) which extends along opposite sides of the tube 109 and prevents rotation of the bracket relative to the tube. The lower end of the bracket includes a pair of spaced-apart support feet 120 and 121 which are separated by a curved bottom edge 122. The radius of curvature of the edge 122 is less than the conventional curvature of the domed top 21 of the propane tank so that the support feet 120 and 121 engage the top of the tank regardless of variations in curvature of the tank.

The connector 112 is screwed onto the POL valve 22 of the fuel tank. The bracket 114 is then pushed downwardly against the top of the tank, and the fastener 116 is tightened to clamp the bracket against the bushing. The connector and the two legs of the bracket form a tripod support which can accommodate tanks having various shaped tops and various POL valve heights.

The rigid assembly of the tube 109, bushing 110, and stem 111 provide both a stable support for the heater and a fuel conduit for conducting fuel from the tank to the regulating valve of the heater.

Operation

The operation of the heater is apparent from the foregoing description to persons skilled in the art. Fuel which is regulated by the regulating valve 40 flows through the fuel orifice in the fitting 47 and into the burner tube 50. The inlet end 51 of the burner tube communicates with ambient air, and air is aspirated into the burner tube with the fuel. Although the fuel orifice is spaced behind the inlet end 51 of the burner tube in the embodiment illustrated in FIG. 2, in smaller capacity heaters the fuel orifice can be positioned forwardly of the inlet end 51.

After the fuel valve 41 is turned on, the pushbutton 45 of the piezoelectric spark generator is depressed to cause a spark to jump from the electrode 94 to the burner head 73. The fuel/air mixture which flows through the burner tube and through the porous burner head 73 is ignited outside of the burner head and burns within the burner enclosure formed by the burner pan 61 and the burner pan screen 68. The flame is confined within the burner enclosure by the dome-shaped screen 73 of the burner head and the burner pan screen 68.

As the fuel/air mixture flows out of the burner tube 50 into the burner head, most of the fuel/air mixture encounters the circular screen 76 on the inside of the burner head. The circular screen 76 increases the density (reduces the porosity) of the screen 73 and redirects some of the fuel/air mixture to the outer portions of the screen 73 which are not covered by the screen 76. The fuel/air mixture therefore flows substantially uniformly throughout the entire surface of the screen 73, and the flame produced by the combustion of the fuel/air mixture within the burner enclosure is substantially uniformly spread or distributed within the burner enclosure. The burner pan screen 68 is substantially uniformly heated across its entire surface, and hot spots and excessive deterioration in localized areas of the screen 68 are thereby prevented.

The rectangular dimensions of the burner pan screen 68 are substantially larger than the dimensions of corresponding screens of prior heater, which are conventionally circular. The larger dimensions of the burner pan screen 68 and the burner enclosure permit a substantially higher rate of fuel consumption and heat output. However, because the heat is spread uniformly throughout the burner enclosure, the depth of the burner enclosure, i.e., the distance between the burner tube 50 or the back of the burner pan 61 and the front of the burner pan screen 68 is relatively shallow so that the resulting burner assembly is not excessively bulky. Preferably the depth of the burner enclosure between the burner pan screen and the back of the burner pan is less than 3 inches.

Increased heat output is also provided by the substantially larger burner tube 50, which has an inside diameter of about one inch. The larger diameter burner tube permits a substantially greater flow of fuel and air through the burner tube. However, even though the flow of the fuel/air mixture is increased, the circular screen 76 of the burner head maintains the noise of the heater at an acceptable level.

The hot, uniformly distributed flame within the burner enclosure causes relatively complete combustion of the fuel, and the emissions of unburned hydrocarbons from the burner assembly are relatively low.

The embodiment of the heater illustrated in FIG. 2 has a heat rating of 45,000 Btu's per hour, which is surprisingly and significantly higher than the heretofore conventional upper limit of about 12,000 to 15,000 Btu's per hour. However, even though the heat rating is substantially higher than that of prior heaters, the useful life of the burner assembly of the inventive heater is longer. Tests of the new burner assembly indicate that the burner assembly has a typical life expectance in the range of about 300 to 400 hours before replacement is required. In contrast, the burner assembly of a prior heater rated at 15,000 Btu's per hour had a life expectancy in the range of 150 to 250 hours.

When the burner assembly does require replacement, replacement can be accomplished quickly and easily. The wire guard on the front of the reflector 33 is removed, and the fastener 59 which extends through the opening in the L-shaped bracket 53 on the burner tube is unscrewed sufficiently to withdraw the bottom end of the fastener from the opening in the bracket. The entire burner assembly consisting of the burner tube, burner tube 50, burner head 73, burner pan 61, and burner pan screen 68 is then withdrawn longitudinally through the opening in the reflector 84 and replaced with a new burner assembly. The fastener 59 is screwed downwardly to retain the new burner assembly, and the wire guard is replaced.

The igniter electrode 90 and the thermocouple sensor 91 do not interfere with removal or replacement of the burner assembly. Both the electrode 90 and the thermocouple 91 extend straight through openings in the back of the burner pan, and withdrawing the burner assembly forwardly as illustrated in FIG. 4 withdraws the burner pan from the electrode and the thermocouple sensor.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A burner assembly for a heater comprising a burner tube having a rear inlet end and a forward outlet end and a fuel passage therethrough, a burner head mounted on the outlet end of the burner tube, the burner head including a first screen which is spaced forwardly from the outlet end of the burner tube, the first screen having a central portion which is aligned with the fuel passage of the burner tube and an outer portion which extends laterally outwardly beyond the burner tube, a second screen which is smaller than the first screen and which is attached to the central portion of the first screen and which extends over at least a portion of the central portion of the first screen, a burner pan having an outer periphery and a central opening through which the burner tube extends, and a third screen enclosing the periphery of the burner pan and spaced in front of the first screen.

2. The burner assembly of claim 1 in which the first screen is generally dome-shaped and curves forwardly from the outlet end of the burner.

3. The burner assembly of claim 2 in which the second screen has a generally circular periphery.

4. The burner assembly of claim 3 in which the burner tube is generally circular in cross section and the diameter of the circular periphery of the second screen is approximately the same as the diameter of the burner tube.

5. The burner assembly of claim 1 in which the second screen has a generally circular periphery.

6. The burner assembly of claim 5 in which the burner tube is generally circular in cross section and the diameter of the circular periphery of the second screen is approximately the same as the diameter of the burner tube.

7. The burner assembly of claim 5 in which the inside diameter of the burner tube is about 1 inch.

8. The burner assembly of claim 1 including a burner pan which is mounted on the burner tube adjacent the outlet end thereof, the burner pan having a generally rectangular outer periphery and a central opening through which the burner tube extends.

9. The burner assembly of claim 8 in which each side of the generally rectangular outer periphery of the burner pan is at least about 5 inches long.

10. The burner assembly of claim 9 in which the outer periphery of the burner pan is spaced less than about 2 inches forwardly of the outlet end of the burner tube.

11. The burner assembly of claim 10 in which the burner tube is generally circular in cross section and has an inside diameter of about 1 inch.

12. The burner assembly of claim 8 including an outer screen attached to the outer periphery of the burner pan and spaced forwardly from the central opening in the burner pan by less than about 3 inches.

13. In a heater having a frame, a burner assembly mounted on the frame, a fuel supply means mounted on the frame for supplying fuel to the burner assembly, the fuel supply means having a fuel outlet, the improvement comprising the burner assembly including an elongated burner tube having a rear inlet end and a forward outlet end, the burner tube being mounted within the frame for slidable movement in the longitudinal direction of the tube, and means releasably securing the burner tube to the frame so that the inlet end of the burner tube is adjacent the fuel outlet of the fuel supply means whereby the burner assembly can be removed from the frame by releasing the securing means and withdrawing the burner tube longitudinally from the frame.

14. The structure of claim 13 in which the securing means comprises a fastener which is threadedly mounted in the frame and which prevents longitudinal movement of the burner tube.

15. The structure of claim 14 including a bracket which is attached to the burner tube adjacent the inlet end thereof and which is supported by the fuel supply means.

16. The structure of claim 15 in which the bracket is provided with an opening through which the fastener extends to prevent longitudinal movement of the burner tube.

17. The structure of claim 15 in which the bracket is provided with an opening through which the fuel supply means extends.

18. The structure of claim 13 including a reflector mounted on the frame and having an opening therein, the burner tube extending slidably through the opening in the reflector.

19. The structure of claim 18 in which the frame includes a pair of spaced-apart brackets, the reflector being mounted on the brackets, the burner tube extending between the spaced-apart brackets and being exposed to ambient air between the brackets.

20. The structure of claim 19 in which each of the brackets include an embossed portion which engages the reflector and spaces the reflector from the remainder of the bracket.

21. The structure of claim 13 in which the burner assembly includes a burner pan which is secured to the burner tube adjacent the outlet end thereof and which extends forwardly from the burner tube, the burner pan having an opening therein, the heater including a thermocouple sensor mounted on the frame and extending through the opening in the burner pan whereby the burner pan can be withdrawn from the thermocouple sensor when the burner tube is withdrawn from the frame.

22. A heater adapted to be removably secured to an LPG tank which includes a generally dome-shaped top and an outlet valve which is mounted on the top, the heater including a heater assembly having a top and a bottom and a support assembly extending downwardly from the heater assembly for supporting the heater assembly on an LPG tank, the support assembly comprising:

a relatively rigid fuel conduit which includes a first portion which extends downwardly from the heater assembly and terminates in a lower end, and a second portion which extends generally transversely to the first portion adjacent the lower end thereof, a connector on the second portion of the fuel conduit which is adapted to be connected to an outlet valve of an LPG tank, a support bracket slidably mounted on the first portion of the fuel conduit adjacent the lower end thereof, the support bracket having a pair of spaced-apart legs which extend below the lower end of the first portion of the fuel conduit and which are adapted to engage a dome-shaped top of an LPG tank, and clamping means on the first portion of the fuel conduit and the support bracket for preventing sliding movement of the support bracket.

23. The heater of claim 22 in which the clamping means includes a fastener which is attached to the first portion of the fuel conduit and extends through an elongated slot in the support bracket, and a clamping member on the fastener which is engageable with the support bracket for clamping the support bracket against the first portion of the fuel conduit.

24. The heater of claim 23 in which the fastener is threadedly engaged with the first portion of the fuel conduit and the clamping member is formed by a head on the fastener.

25. The heater of claim 23 in which the portion of the fastener which extends through the slot in the support bracket is threaded and the clamping member comprises a nut which is threadedly engaged with the fastener.

26. The heater of claim 22 in which the support bracket includes an upper end and a pair of arms which extend along opposite sides of the first portion of the fuel conduit for preventing rotation of the support bracket relative to the first portion of the fuel conduit.

27. A heater adapted to be removably secured to an LPG tank which includes a generally dome-shaped top and an outlet valve which is mounted on the top, and a collar which extends around at least a portion of the outlet valve, the heater including a heater assembly having a top and a bottom and a support assembly extending downwardly from the heater assembly for supporting the heater assembly on a propane tank, the support assembly comprising:

a rigid support member which extends downwardly from the heater assembly and terminates in a lower end, a support bracket which is secured to the support member and includes a shoulder portion which extends outwardly from the support member, a generally L-shaped fastener having a first portion which extends slidably through the downwardly extending support member below the shoulder portion of the support bracket and an end portion which extends generally perpendicularly to the first portion, and clamping means for forcing the end portion of the fastener toward the support member whereby the support assembly can be mounted on an LPG tank by inserting a collar of an LPG tank between the support member and the end portion of the fastener, supporting the shoulder portion of the support bracket on the collar, and clamping the collar between the end portion of the fastener and the support member.

28. The heater of claim 27 in which the support bracket includes an lower end portion which extends downwardly from the shoulder portion adjacent to but spaced from the support member whereby the collar of an LPG tank may be positioned between the end portion and the support member.

29. The heater of claim 28 in which the end portion of the support bracket is provided with a slot through which the end portion of the fastener can be inserted.

30. The heater of claim 28 in which the support member includes a recessed portion in which the end portion of the fastener can be positioned to permit the collar of an LPG tank to be inserted between the end portion of the fastener and the lower end portion of the support bracket.

31. The heater of claim 27 in which the clamping means includes a knob which is threadedly engaged with the first portion of the fastener and which is engageable with the support member.

* * * * *